US007506827B2

(12) United States Patent
Petrone et al.

(10) Patent No.: US 7,506,827 B2
(45) Date of Patent: Mar. 24, 2009

(54) FUEL INJECTOR WITH AN ANTIREBOUND DEVICE

(75) Inventors: Michele Petrone, San Lazzaro Di Savena (IT); Luca Cagnolati, Bologna (IT); Luca Mancini, Budrio (IT); Marcello Cristiani, Imola (IT); Mauro Venturoli, Monte San Pietro (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 151 days.

(21) Appl. No.: 10/546,063

(22) PCT Filed: Feb. 20, 2004

(86) PCT No.: PCT/EP2004/050174

§ 371 (c)(1),
(2), (4) Date: Dec. 13, 2005

(87) PCT Pub. No.: WO2004/074673

PCT Pub. Date: Sep. 2, 2004

(65) Prior Publication Data

US 2006/0192035 A1 Aug. 31, 2006

(30) Foreign Application Priority Data

Feb. 21, 2003 (IT) ..... BO2003A0090

(51) Int. Cl.
*F02M 51/00* (2006.01)

(52) U.S. Cl. ..... 239/585.1; 239/585.5

(58) Field of Classification Search ..... 239/585.1–586, 239/900

See application file for complete search history.

(56) References Cited

U.S. PATENT DOCUMENTS

| | | | | |
|---|---|---|---|---|
| 4,360,161 | A | 11/1982 | Claxton et al. | |
| 6,367,769 | B1 | 4/2002 | Reiter | |
| 6,520,434 | B1 | 2/2003 | Reiter | |
| 6,578,778 | B2 * | 6/2003 | Koizumi et al. | 239/533.12 |
| 6,616,071 | B2 * | 9/2003 | Kitamura et al. | 239/533.12 |

FOREIGN PATENT DOCUMENTS

| | | |
|---|---|---|
| DE | 199 50 761 | 4/2001 |
| EP | 1 199 465 | 4/2002 |
| JP | 08177689 | 7/1996 |
| WO | WO 02/12709 | 2/2002 |
| WO | WO 03/072928 | 9/2003 |

* cited by examiner

*Primary Examiner*—Christopher S Kim
(74) *Attorney, Agent, or Firm*—Gottlieb, Rackman & Reisman

(57) ABSTRACT

A fuel injector (1) having an injection valve (7) with a movable pin (15); and an actuator (5) for moving the pin (15) between a closed position and an open position; the actuator (5) has a movable armature (10), and an antirebound device (20) interposed between the movable armature (10) and the pin (15) to connect the movable armature (10) and the pin (15) mechanically; the antirebound device (20) has a deformable elastic plate (32; 45; 48) which is annular in shape, is connected centrally to the pin (15), and is connected laterally to the armature (10) to transmit at least the closing movement of the injection valve (7) from the armature 15 (10) to the pin (15).

13 Claims, 9 Drawing Sheets

FUEL INJECTOR WITH AN ANTIREBOUND DEVICE

TECHNICAL FIELD

The present invention relates to a fuel injector.

In the following description, specific reference is made, purely by way of example, to an electromagnetic injector for a direct fuel injection system.

BACKGROUND ART

An electromagnetic fuel injector normally comprises a cylindrical tubular body having a central through hole, which acts as a fuel conduit and terminates with an injection nozzle regulated by an injection valve controlled by an electromagnetic actuator. More specifically, the injection valve has a pin connected rigidly to a movable armature of the electromagnetic actuator, and which is moved by the electromagnetic actuator between a closed position, and an open position opening the injection nozzle in opposition to a spring which keeps the pin in the closed position.

An electromagnetic fuel injector of the type described above is illustrated, for example, in U.S. Pat. No. 6,027,050A1, which relates to a fuel injector having a movable assembly defined by a pin which, at one end, cooperates with a valve seat, and, at the opposite end, is integral with a movable armature of an electromagnetic actuator. The movable assembly is guided at the top by a guide cooperating with the armature, and is guided at the bottom by the end portion of the pin sliding inside a guide portion of the valve seat.

A drawback of known injectors of the type described above lies in rebound of the pin on impact with the valve seat of the injection valve, and which is not fully damped by the spring connected to the movable armature. On the contrary, it may even produce oscillation of the movable armature, thus resulting in successive, undesired opening/closing of the injection nozzle and, hence, undesired fuel injection into the combustion chamber, so that the amount of fuel actually injected into the combustion chamber involves a certain random element.

In an attempt to eliminate rebound of the pin against the valve seat of the injection valve, fuel injectors have been proposed with hydraulic and mechanical antirebound devices. Known antirebound devices, however, are complex and therefore expensive to produce, and normally fail to effectively eliminate rebound of the pin against the valve seat of the injection valve.

DISCLOSURE OF INVENTION

It is an object of the present invention to provide a fuel injector designed to eliminate the aforementioned drawbacks, and which, in particular, is cheap and easy to produce.

According to the present invention, there is provided a fuel injector as claimed in claim 1 and, preferably, in any one of the following claims depending directly or indirectly on claim 1.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
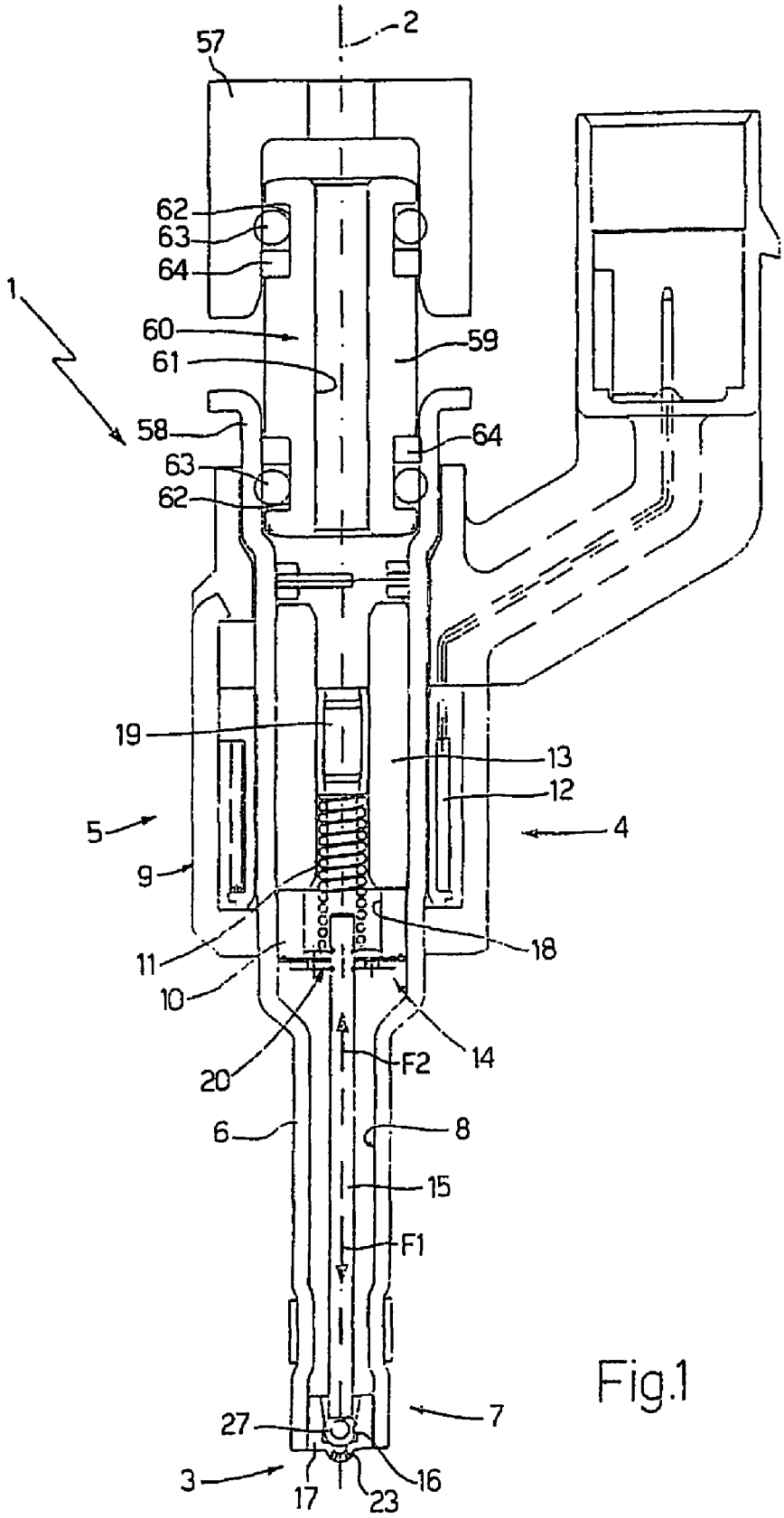
FIG. 1 shows a schematic, partly sectioned side view of a fuel injector in accordance with the present invention.

Number 1 in FIG. 1 indicates as a whole a fuel injector which is substantially cylindrically symmetrical about a longitudinal axis 2, and is controlled to inject fuel from an injection nozzle 3 which comes out directly inside a combustion chamber (not shown) of a cylinder. Injector 1 comprises an actuator body 4 housing an electromagnetic actuator 5; and a valve body 6 integral with actuator body 4 and housing an injection valve 7 activated by electromagnetic actuator 5 to regulate fuel flow through injection nozzle 3. Valve body 6 has a channel 8 extending the full length of valve body 6 to feed pressurized fuel to injection nozzle 3.

Electromagnetic actuator 5 comprises an electromagnet 9 housed in a fixed position inside actuator body 4, and which, when energized, moves an armature 10 of ferromagnetic material along axis 2 from a closed position (shown in the accompanying drawings) to an open position (not shown) opening injection valve 7 in opposition to a spring 11 which keeps armature 10 in the closed position closing injection valve 7. More specifically, electromagnet 9 comprises a coil 12 powered electrically by an electronic control unit (not shown); and a magnetic core 13 having a central hole to permit fuel flow to injection nozzle 3.

Armature 10 forms part of a movable assembly 14 also comprising a shutter or pin 15, which comprises a top portion integral with armature 10, and a bottom portion cooperating with a valve seat 16 of injection valve 7 to regulate fuel flow from injection nozzle 3 in known manner. Valve seat 16 is defined in a sealing member 17 which closes the bottom of channel 8 of valve body 6 hermetically; and injection nozzle 3 is defined in a bottom portion of sealing member 17.

Armature 10 is cylindrically annular in shape, and has a central hole 18 for substantially permitting fuel flow to injection nozzle 3. A top end of spring 11 rests on a stop member 19 inside the central hole of core 13, and a bottom end of spring 11 rests on movable assembly 14.

Movable assembly 14 comprises an antirebound device 20 interposed between armature 10 and pin 15 to connect armature 10 and pin 15 mechanically, and for damping rebound of pin 15 against valve seat 16 when movable assembly 14 moves from the open position to the closed position closing injection valve 7.

Figure 2:
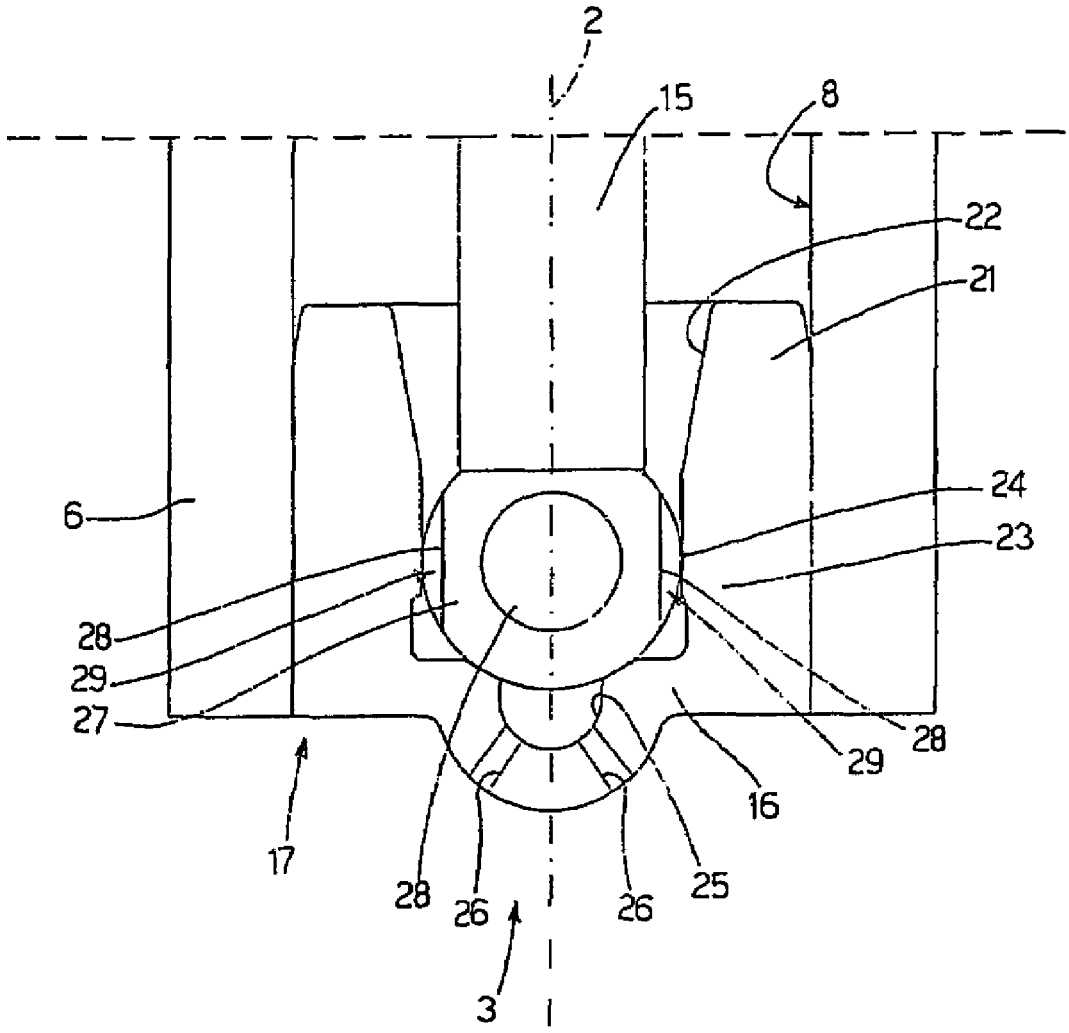
FIG. 2 shows a larger-scale view of the injection valve of the FIG. 1 injector.

As shown in FIG. 2, sealing member 17 comprises a top portion 21 having a flared inner hole 22; and a bottom portion 23 having a cylindrical hole 24, which is an ideal continuation of flared hole 22 and comes out inside an injection chamber 25. Injection chamber 25 in turn comprises a number of through holes 26 defining injection nozzle 3 by which fuel is injected into the combustion chamber (not shown). Flared hole 22 and cylindrical hole 24 together define the valve seat 16 of injection valve 7.

Pin 15 terminates with a substantially spherical shutter head 27, which rests hermetically on a surface of cylindrical hole 24 extending about injection chamber 25, to prevent fuel flow to injection chamber 25 when pin 15 is in the closed position. Four flat faces 28 (only three shown in FIG. 2) are formed parallel to axis 2 to define, with cylindrical hole 24, four passages 29 permitting fuel flow to injection chamber 25.

Figure 3:
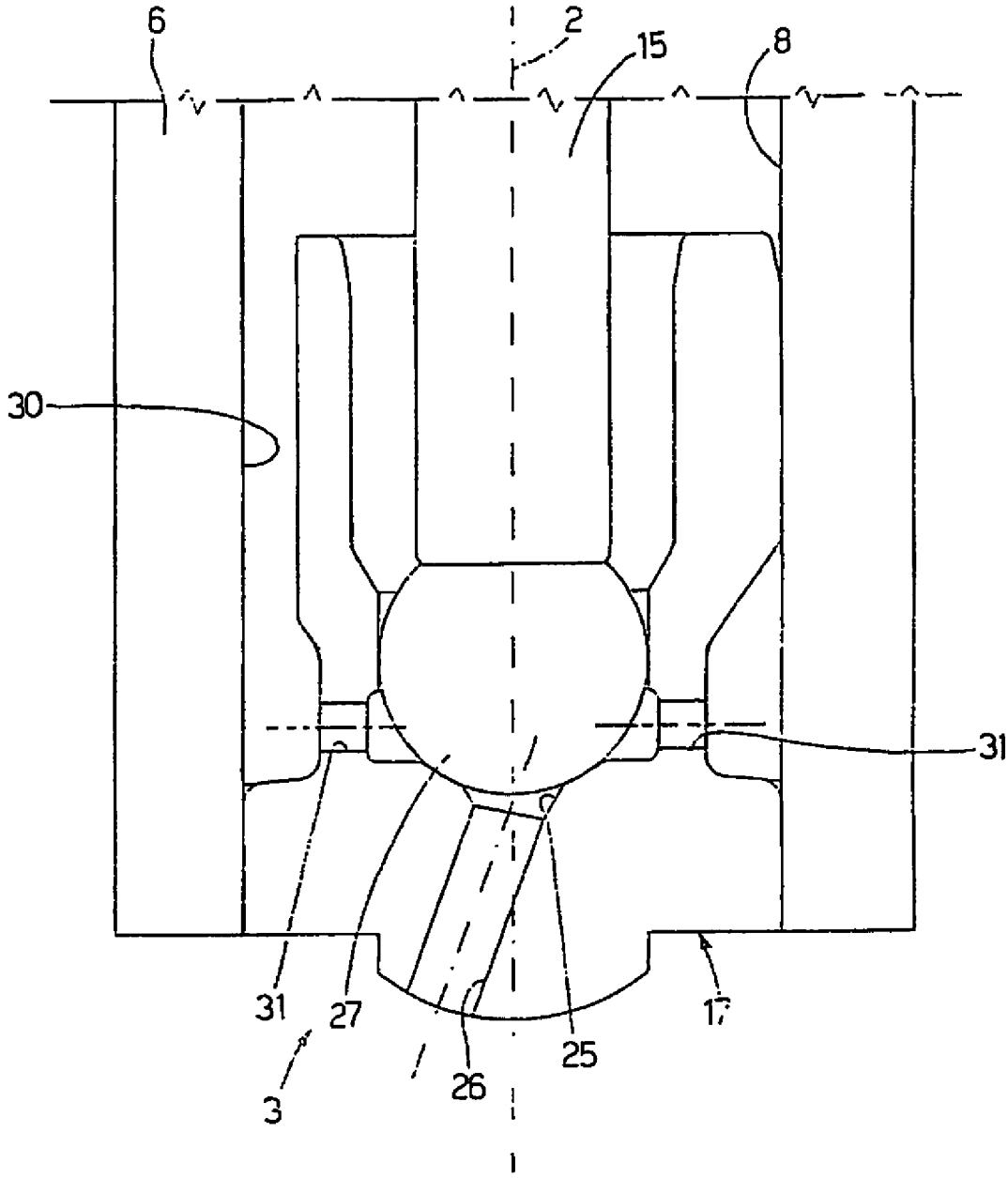
FIG. 3 shows a larger-scale view of a different embodiment of the injection valve of the FIG. 1 injector.

FIG. 3 shows an alternative embodiment of injection valve 7, in which head 27 has no flat faces; and four recesses 30 (only one shown fully in FIG. 3) are formed on the outer surface of sealing member 17 to define four respective passages permitting fuel flow to four corresponding through holes 31 perpendicular to longitudinal axis 2 and terminating towards injection chamber 25. Through holes 31 are offset with respect to longitudinal axis 2 so as not to converge towards longitudinal axis 2, and so as to produce swirl, in use, in the respective fuel flows. As shown in FIG. 3, a single hole 26, sloping with respect to axis 2, is preferably provided.

Figure 4:
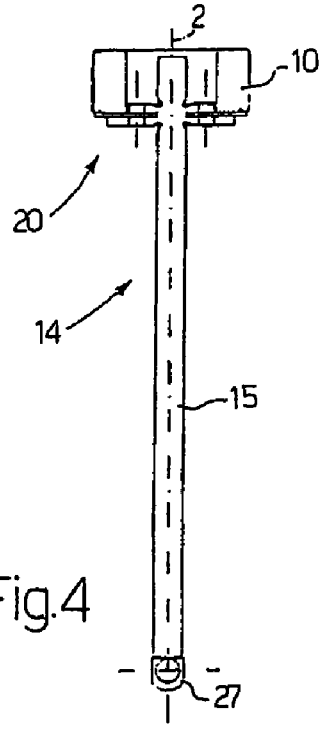
FIG. 4 shows a larger-scale view of a first embodiment of a movable assembly of the FIG. 1 injector.
Figure 5:
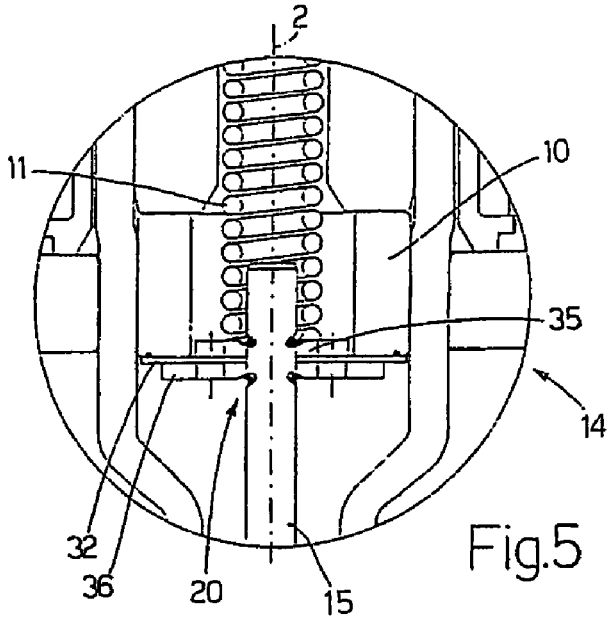
FIG. 5 shows a larger-scale detail of the movable assembly in FIG. 4.
Figure 6:
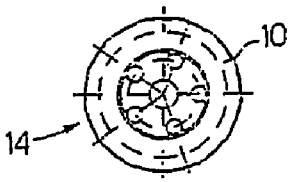
FIG. 6 shows an exploded view in perspective of the movable assembly in FIG. 4.
Figure 6:
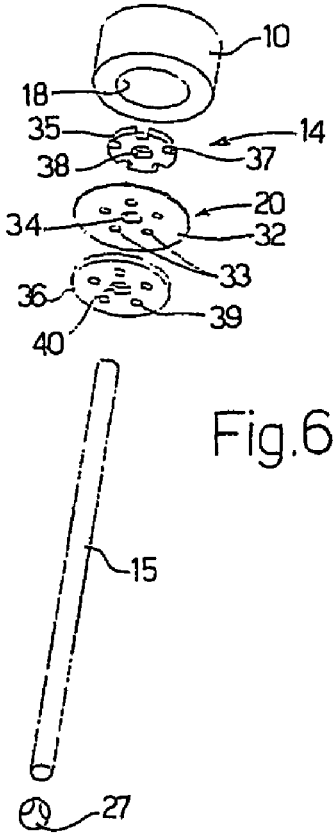

As shown in FIGS. 4 to 6, antirebound device 20 comprises an elastic central plate 32 welded to armature 10 and having five peripheral through holes 33, and a central through hole 34 for receiving pin 15. In this first embodiment, antirebound device 20 is complete with two elastic lateral plates 35 and 36, which are welded to pin 15 and located on opposite sides of central plate 32 so as to sandwich central plate 32. Lateral plate 35 has five peripheral notches 37 (or equivalent through holes 37) and a central through hole 38, and lateral plate 36 has five peripheral through holes 39 and a central through hole 40.

As shown in FIG. 6, central hole 18 of armature 10, central hole 34 of central plate 32, central hole 38 of lateral plate 35, and central hole 40 of lateral plate 36 are aligned with one another and coaxial with longitudinal axis 2 to receive pin 15; and peripheral holes 33 of central plate 32, notches 37 of lateral plate 35, and peripheral holes 39 of lateral plate 36 are aligned with one another to define a passage permitting fuel flow to injection nozzle 3.

In a different embodiment not shown, as opposed to welding lateral plates 35 and 36 to pin 15, two additional bushings may be welded to pin 15 on opposite sides of lateral plates 35 and 36 to grip lateral plates 35 and 36 together.

The function of antirebound device 20 is to damp rebound of pin 15 against valve seat 16 when movable assembly 14 moves from the open position to the closed position closing injection valve 7, and is substantially achieved hydraulically, i.e. by a sort of pumping effect of the fuel accumulating alternatively in two minute chambers formed on opposite sides of central plate 32 by deformation of lateral plates 35 and 36 and central plate 32 itself. More specifically, when opening injector 1 (i.e. when movable assembly 14 moves upwards in the direction of arrow F2 in FIG. 1), fuel is accumulated in and then expelled from the chamber formed by upward deformation (arrow F2) of lateral plate 35 and central plate 32 with respect to lateral plate 36. And conversely, when closing injector 1 (i.e. when movable assembly 14 moves downwards in the direction of arrow F1 in FIG. 1), fuel is accumulated in and then expelled from the chamber formed by deformation of lateral plate 36 and central plate 32 with respect to lateral plate 35. The pumping action followed by expulsion and compression induces a certain amount of energy dissipation on movable assembly 14, which is prevented from oscillating, thus preventing undesired rebound of pin 15 and undesired opening/closing cycles of injection chamber 25.

It is important to note that, in addition to the above hydraulic effect, the antirebound function of antirebound device 20 is also achieved to a small extent mechanically by deformation of lateral plates 35 and 36 and central plate 32 inducing further energy dissipation on movable assembly 14.

Figure 7:
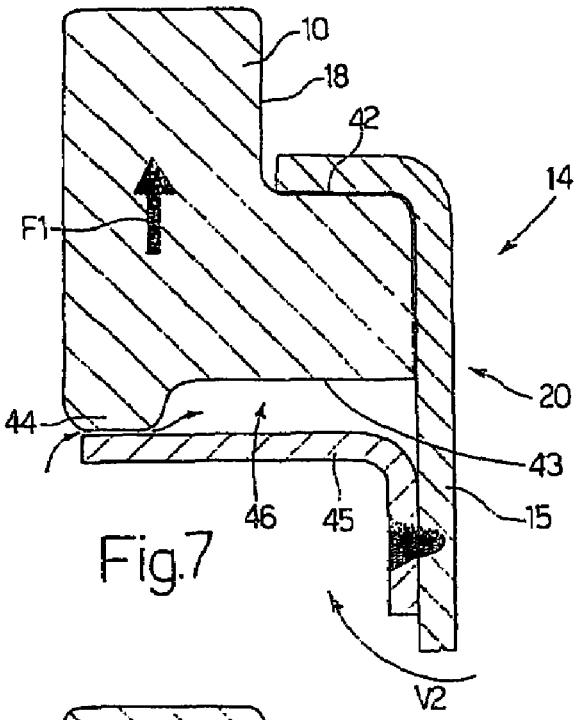
FIG. 7 shows a larger-scale view of a second embodiment of a movable assembly of the FIG. 1 injector.
Figure 8:
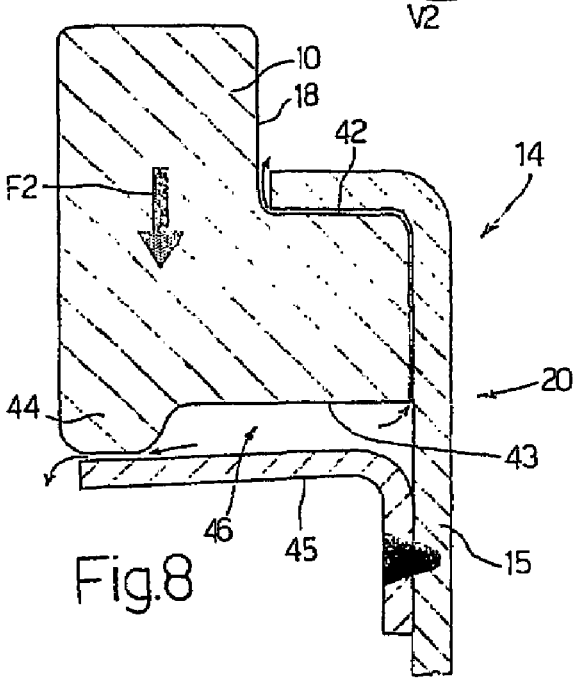
FIGS. 8 and 9 show larger-scale details of the FIG. 7 movable assembly at two different stages in its travel.
Figure 9:
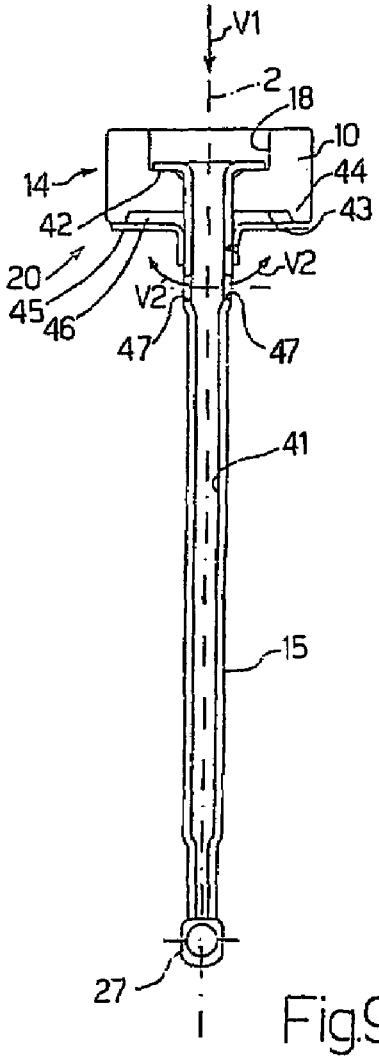

FIGS. 7 to 9 show a different embodiment of antirebound device 20, in which pin 15 is hollow, and has a cylindrical inner cavity 41 coaxial with longitudinal axis 2. The top end of pin 15 is flared, and rests on a shoulder 42 formed inside central through hole 18 of armature 10; the top end of pin 15 is located inside hole 18 and rests on shoulder 42; and the bottom face of armature 10 comprises a recess 43 having an edge 44.

An annular elastic plate 45 is welded to pin 15, and is preloaded slightly by being pushed against edge 44; an annular fuel pumping chamber 46 is thus defined inside recess 43 by the bottom surface of armature 10, plate 45, edge 44 of recess 43, and pin 15; and pin 15 has at least two openings 47 connecting cavity 41 hydraulically to channel 8 of valve body 6, so that, when movable assembly 14 moves upwards in the direction of arrow F2 (to open injection valve 7), fuel flows through cavity 41 of pin 15 in the direction of arrows V1 and V2.

When movable assembly 14 moves in the direction of arrow F1 (to close injection valve 7), and once injection valve 7 is closed by the relative movement of armature 10 and pin 15, fuel is not only expelled from the gap between edge 44 and deformable annular plate 45, but also seeps inside the narrow gap between pin 15 and hole 18 of armature 10. FIG. 8 shows how the liquid fuel is subsequently fed into pumping chamber 46 by elastic plate 45 moving armature 10 back into position. In this case too, therefore, there is a predominant hydraulic effect, which dissipates considerable energy to prevent movable assembly 14 rebounding against valve seat 16.

FIGS. 10 to 14 show a further embodiment of antirebound device 20, in which antirebound device 20 comprises an elastic plate 48 welded to armature 10 and having a central through hole 49 for receiving pin 15, and three through slots 50 shaped to define a substantially annular central region 51 about central hole 49, and a peripheral region 52. As shown more clearly in FIGS. 13 and 14, central region 51 of plate 48 is thinner than peripheral region 52; and, by virtue of the shape of slots 50, and being thinner, central region 51 of plate 48 is highly deformable axially (i.e. in a direction parallel to longitudinal axis 2) with respect to peripheral region 52.

Figure 10:
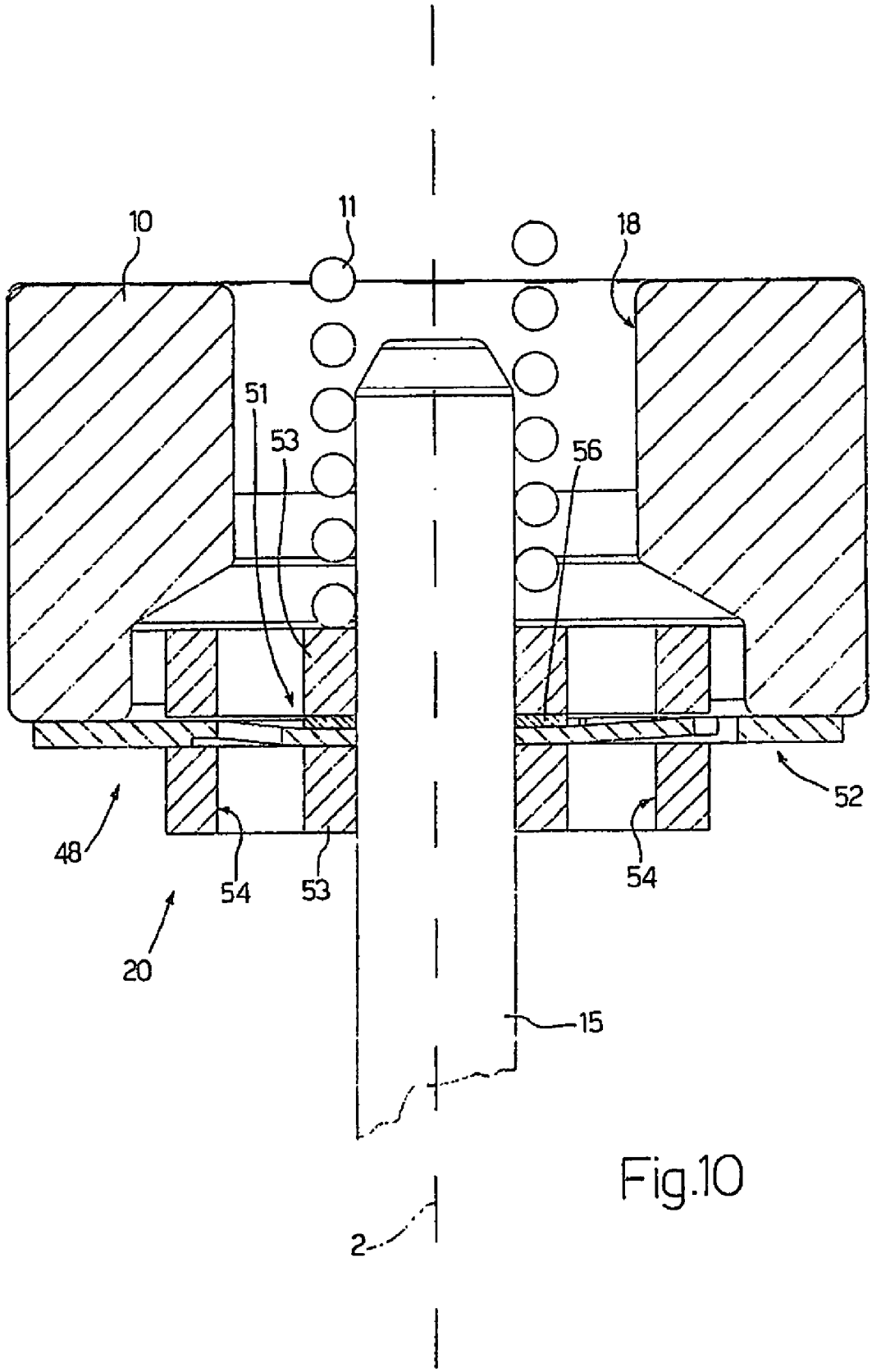
FIG. 10 shows a larger-scale view of a third embodiment of a movable assembly of the FIG. 1 injector.

As shown in FIG. 10, plate 48 is welded to armature 10 at peripheral region 52, and is secured mechanically to pin 15, at central region 51, by two rigid annular plates 53 welded to pin 15 and located on opposite sides of plate 48 to grip plate 48 between them.

Each plate 53 has four lateral through slots 54, and a central through hole 55. Central hole 18 of armature 10, central hole 49 of plate 48, and central holes 55 of plates 53 are aligned with one another and coaxial with longitudinal axis 2 to receive pin 15; and slots 50 of plate 48, and lateral slots 54 of plates 53 are at least partly superimposed to define a fuel passage to injection nozzle 3.

In actual use, when closing injector 1, movable assembly 14 moves downwards in the direction of arrow F1 in FIG. 1 to bring head 27 to rest against valve seat 16 with a given impact speed. Following impact, head 27 and, consequently, pin 15 remain substantially stationary, while armature 10 is oscillated about a final balance position by the presence of elastic plate 48 and the kinetic energy of movable assembly 14 upon impact. Only a minimum part of the oscillation of armature 10 is transmitted to pin 15 and head 27, and is gradually damped by the dissipation of energy in and by continual deformation of plate 48.

As will be clear from the above description, the antirebound function of antirebound device 20 is substantially achieved mechanically, by deformation of plate 48 inducing energy dissipation on movable assembly 14; and the above mechanical effect is also accompanied to a much lesser degree by a hydraulic effect which dissipates energy on movable assembly 14 in exactly the same way as described with reference to the FIG. 4 to 6 embodiment of antirebound device 20.

Figure 11:
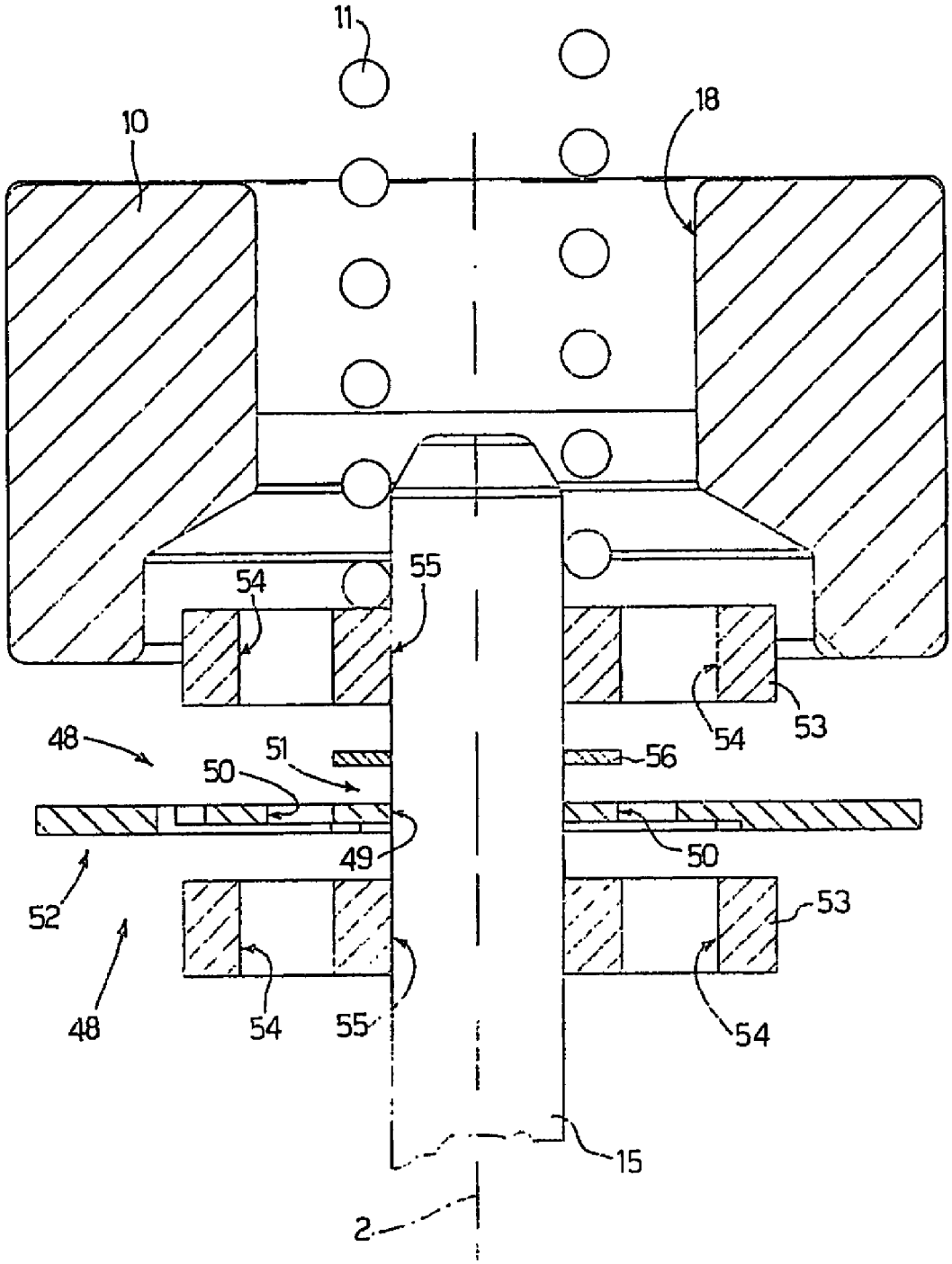
FIG. 11 shows an exploded view of the movable assembly in FIG. 10.
Figure 12:
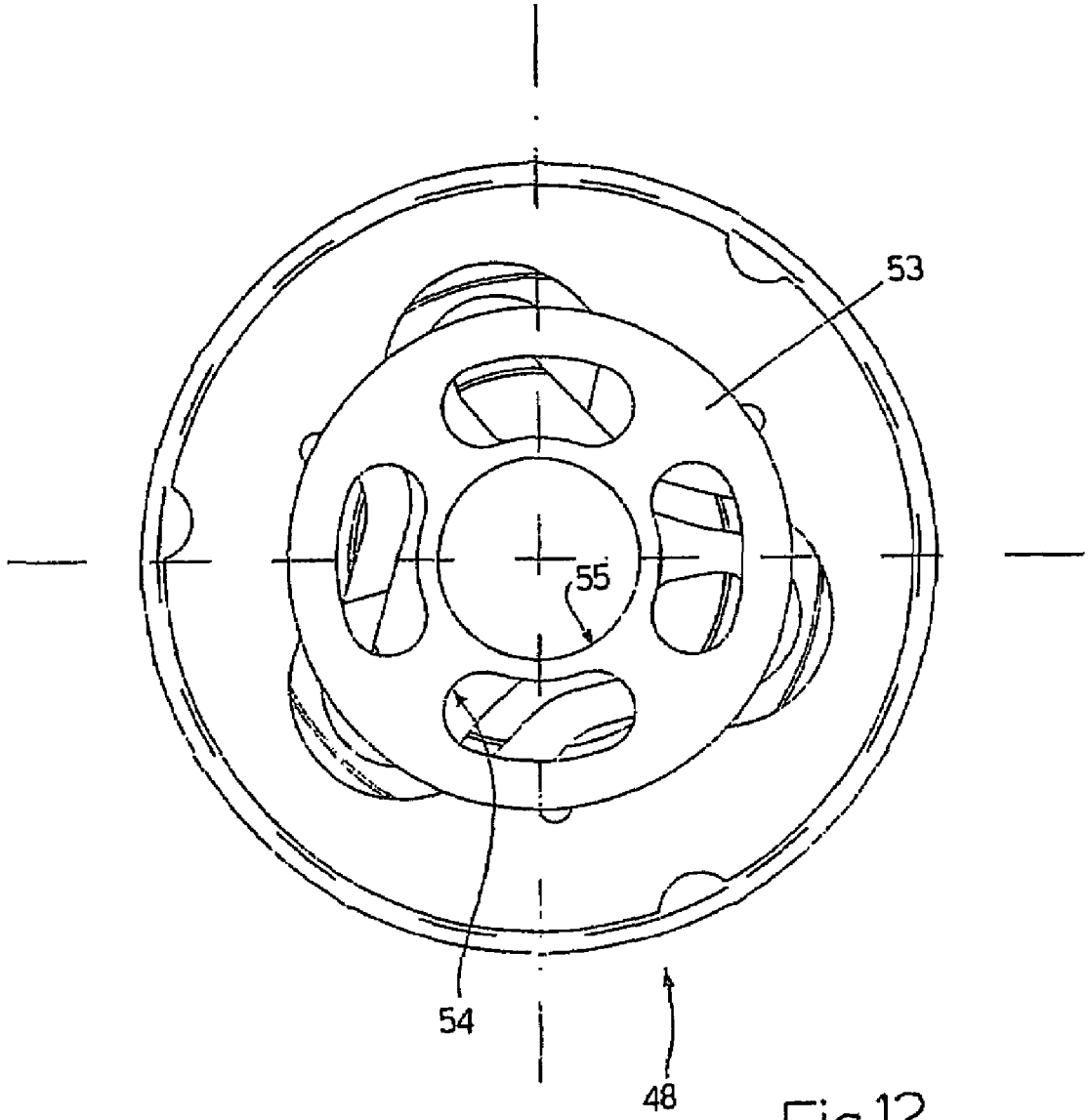
FIG. 12 shows a plan view of a detail of the movable assembly in FIG. 10.
Figure 13:
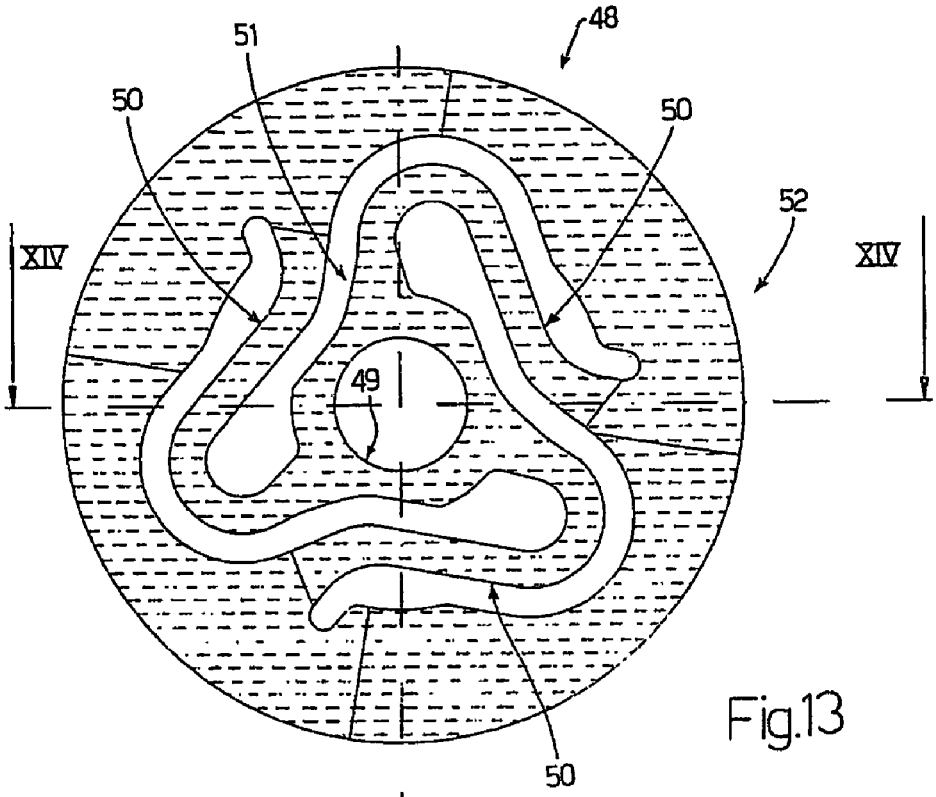
FIG. 13 shows a plan view of an elastic plate in FIG. 12.
Figure 14:
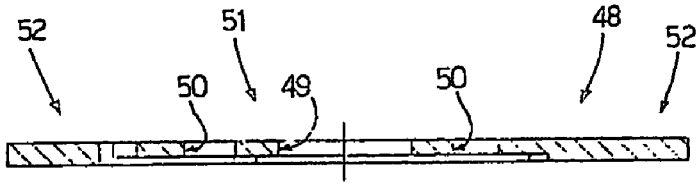
FIG. 14 shows a side section along line XIV-XIV of the elastic plate in FIG. 13.

In a preferred embodiment shown in FIGS. 10 and 11, an annular body 56 is interposed between central region 51 of plate 48 and the top plate 53, to enable accelerated pretravel of armature 10 when opening injector 1 (i.e. when movable assembly 14 moves upwards in the direction of arrow F2 in FIG. 1). At the start of the opening stage, head 27 contacts valve seat 16. As of this condition, armature 10 is drawn electromagnetically towards electromagnet 9, in opposition to the force exerted by spring 11, so that, to open injection valve 7, armature 10, and with it the whole of movable assembly 14, must accelerate from a rest condition to move upwards in the direction of arrow F2 in FIG. 1. Annular body 56 is provided so that the initial travel of armature 10 takes place without involving pin 15 for a distance defined by the thickness of annular body 56. In other words, initially, for a distance substantially equal to the thickness of annular body 56, armature 10 moves upwards without moving pin 15, on account of elastic plate 48 not initially contacting rigid top plate 53. Only after armature 10 has travelled a distance defined by the thickness of annular body 56, does elastic plate 48 contact rigid top plate 53, and armature 10 continues moving upwards together with pin 15.

The accelerated pretravel function of annular body 56 is to assist initial acceleration of armature 10, during which armature 10 must overcome a small amount of inertia (pin 15 does not move). This improves the dynamic performance of injector 1 when it is opened, in that one of the problems of electromagnetic fuel injectors is the sluggish opening response caused by poor initial acceleration of the magnetic armature.

As shown in FIG. 1, an adapter 59 is provided between a feed pipe 57, for feeding fuel to injector 1, and a head 58 of injector 1, and comprises a cylindrical main body 60 having a central through hole 61 coaxial with longitudinal axis 2; and each end of main body 60 has an annular recess 62 housing a sealing ring (O-ring) 63 and an antiextrusion ring 64.

It is important to note the innovative "male/male" design of adapter 59, in that both feed pipe 57 and head 58 of injector 1 have "female" ends, as shown in FIG. 1. Using adapter 59 ensures fluidtight sealing of the connection between feed pipe 57 and head 58 of injector 1, even in the event of misalignment of head 58 of injector 1 with respect to feed pipe 57. That is, adapter 59 provides for correcting any relative position errors (due to manufacturing and assembly tolerances) between feed pipe 57 and head 58 of injector 1.

As will be clear from the foregoing description, armature 10 also acts as a top guide for pin 15, i.e. assists in keeping pin 15 aligned with respect to valve seat 16, and allows pin 15 to move along axis 2 under the control of electromagnetic actuator 5.

The particular design of shutter head 27 permits a sliding connection of head 27 and cylindrical hole 24, so that pin 15, and consequently movable assembly 14, is guided at the bottom by the connection between head 27 and sealing member 17, and is guided at the top by the connection between armature 10 and the inner walls of channel 8 of valve body 6. Converting the bottom guide of movable assembly 14 from a cylindrical to a spherical-cylindrical connection, together with the particular connection of armature 10 and pin 15 by antirebound device 20, provides for correcting any misalignment (due to manufacturing and/or assembly tolerances), thus enabling use of a one-piece drawn valve body 6 requiring no further grinding inside.

The invention claimed is:

1. A fuel injector (1) comprising an injection nozzle (3);

an injection valve (7) having a movable pin (15) for regulating fuel flow through the injection nozzle (3); and an actuator (5) for moving the pin (15) between a closed position and an open position opening the injection valve (7) in opposition to a spring (11) which keeps the pin (15) in the closed position; the actuator (5) comprising a movable armature (10) connected mechanically to the pin (15), and an antirebound device (20), which is interposed between the movable armature (10) and the pin (15) to connect the movable armature (10) and the pin (15) mechanically and comprises at least one deformable elastic plate (32; 45; 48) having a periphery;

wherein the plate which is annular in shape and has two opposite base walls, is connected centrally to the pin (15), and is connected laterally to the armature (10) to transmit at least the closing movement of the injection valve (7) from the armature (10) to the pin (15);

wherein the deformable elastic plate (32; 48) is rigidly secured centrally to the pin (15), and is directly connected to the armature (10) at the periphery of said plate such that it is rigidly secured laterally to the armature (10) to connect the armature (10) and the pin (15) mechanically for transmitting the movement of the injection valve (7) from the armature (10) to the pin (15); and wherein the antirebound device (20) comprises two annular first bodies (35, 36; 53) connected rigidly to the pin (15) and contacting directly the two opposite base walls of the deformable elastic plate (32; 48) to sandwich the elastic plate (32; 48) between them.

2. An injector (1) as claimed in claim 1, wherein the elastic plate (32; 48) and the annular first bodies (35, 36; 53) comprise respective through holes (33, 37, 38; 50, 54) permitting fuel passage.

3. An injector (1) as claimed in claim 1, wherein the annular first bodies (35, 36) are elastic and deformable.

4. An injector (1) as claimed in claim 1, wherein the annular first bodies (53) are rigid and substantially undeformable.

5. An injector (1) as claimed in claim 4, wherein a second annular body (56) is interposed between a top of the annular first bodies (53) and the elastic plate (48) to define an accelerated pretravel of the movable armature (10) at the opening stage.

6. An injector (1) as claimed in claim 4, wherein the elastic plate (48) has a through central hole (49) for receiving the pin (15), and a number of through slots (50) shaped to define a substantially annular central region (51) about the central hole (49), and a peripheral region (52); the central region (51) of the elastic plate (48) being deformable axially with respect to the peripheral region (52).

7. An injector (1) as claimed in claim 6, wherein the central region (51) of the elastic plate (48) is thinner than the peripheral region (52).

8. An injector (1) as claimed in claim 1, wherein the pin (15) is hollow, and has a flared top end to rest on a shoulder (42) formed in a through central hole (18) of the armature (10); the top end of the pin (15) being located inside the hole (18) and resting on the shoulder (42); the bottom face of the armature (10) having a recess (43) which has an annular edge (44) and is closed by the annular elastic plate (45) to define a pumping chamber (46); and the pin (15) having a number of through openings (47) permitting fuel flow through the pin (15) to the injection nozzle (3).

9. An injector (1) as claimed in claim 8, wherein the annular elastic plate (45) is welded to the pin (15), and is pushed against the edge (44) of the recess (43) to impart a slight preload to the elastic plate (45).

10. An injector as claimed in claim 1, wherein the actuator (5) is an electromagnetic actuator, and comprises a fixed core (13) connected to a coil (12) and which attracts the movable armature (10) magnetically in opposition to the force of the spring (11).

11. An injector as claimed in claim 1, wherein the pin (15) has a substantially spherical shutter head (27) which engages a valve seat (16) of the injection valve (7).

12. An injector as claimed in claim 11, wherein the shutter head (27) comprises a number of flat faces (28) defining, with at least one portion of the valve seat (16), a number of passages (29) permitting liquid fuel flow to an injection chamber (25) of the injection nozzle (3).

13. An injector as claimed in claim 11, wherein the shutter head (27) rests on an inlet portion of an injection chamber (25) of the injection nozzle (3); the injection chamber (25) being supplied by transverse holes (31) arranged so as not to converge towards a longitudinal axis (2) of the injector (1), and so as to impart swirl to the fuel flow.

* * * * *